United States Patent [19]

Westlund

[11] 4,015,405

[45] Apr. 5, 1977

[54] ALL PURPOSE TRAINING HARNESS

[76] Inventor: Patricia R. Westlund, 6879 E. Cholla St., Scottsdale, Ariz. 85254

[22] Filed: May 22, 1975

[21] Appl. No.: 579,920

[52] U.S. Cl. ..... 54/71; 119/29

[51] Int. Cl.[2] ..... B68B 1/00

[58] Field of Search ..... 54/71, 24; 119/126, 119/29

[56] References Cited

UNITED STATES PATENTS

| | | | |
|---|---|---|---|
| 806,858 | 12/1905 | Westrope | 54/71 |
| 1,212,023 | 1/1917 | Curley | 54/71 |
| 2,761,266 | 9/1956 | Habkink | 54/71 |

*Primary Examiner*—Louis G. Mancene
*Assistant Examiner*—Peter K. Skiff

[57] ABSTRACT

An all purpose training harness for horses comprising an adjustable two part top strap. A tail strap is detachably connected to the top strap. Rear and front cross straps of inverted U shape are affixed to the top strap. An adjustable strap hanger is suspended from each end of each of the cross straps. A breast strap is adjustably connected to the front strap hanger. A body strap is supported by the strap hangers and comprises two side parts of an elastic material, a U shaped hind part and a U shaped front part.

4 Claims, 4 Drawing Figures

ALL PURPOSE TRAINING HARNESS

The present invention relates to an all purpose training harness and is concerned primarily with such a harness which is adjustable to accommodate horses in size of a foal to full maturity and which includes elements which provide training for: loading into a trailer, reining, leading, driving and breeding.

BACKGROUND OF THE INVENTION

At the present time horses are trained for various functions or performances. Among such are: loading into a trailer, reining, leading, driving and breeding. Moreover, a horse is subject to certain phases of such training from the time he is foaled through his mature years. Thus an all purpose training harness should be adjustable to accommodate the changes in the size of a horse as he grows.

While there are many instances of harness for training pacers and trotters, so far as the present applicant is aware, there is only one known training harness which includes a body strap that encircles a horse at or below its breast and at the lower regions of the hind quarters. However the training functions of which this known harness is capable are quite limited.

OBJECTS OF THE INVENTION

With the foregoing condition in mind the present invention has in view the following objectives:

1. To provide in an all purpose training harness including various elements which are adjustable in length and extent whereby the harness is adapted to accommodate horses of all sizes ranging from that of a foal to a mature horse.

2. To provide a training harness of the character aforesaid which is susceptible of the use for training a horse for loading into a trailer, reining, leading, driving and breeding.

3. To provide in a training harness of the type noted, a top strap which is adjustable in length and on which is mounted a buckle at the rear end which constitutes an anchorage for a tail strap when one is used and a hook at the front end to which an overcheck strap may be secured.

4. To provide in a training harness of the kind described hind and fore cross straps of inverted U shape which are secured to the top strap.

5. To provide in a training harness of the type noted, a hind cross strap having buckles mounted thereon which are susceptible of use in securing a breeding strap thereto.

6. To provide in a training harness of the character aforesaid a front cross strap having a pair of rings mounted on its upper side and on opposite sides of the front strap through which reins are adapted to pass.

7. To provide in a training harness of the kind described, four strap hangers each of which is suspended from the lower ends of the cross straps and which are adjustable in length.

8. To provide in a training harness of the type noted, a breast strap having ends adjustably secured to the upper ends of the strap hangers at the front.

9. To provide in a training harness of the character aforesaid, a body strap comprising a pair of elastic side parts, a U shaped hind strap having its ends adjustably connected to the rear ends of the side parts, and a U shaped front strap having its ends adjustably connected to the front ends of the side parts together with means for securing a lead line to the center part of the front strap.

Various other more detailed objects and advantages of the invention, such as arise in connection with carrying out the above ideas in a practical embodiment, will, in part, become apparent and, in part, be hereinafter stated as the description of the invention proceeds.

SUMMARY OF THE INVENTION

The foregoing objects are achieved by providing a harness that includes, as a characteristic and essential element, a two part top strap of leather. This top strap comprises a hind part and a fore part which are connected by a buckle that renders the effective length of the top strap, when considered in its entirety adjustable. Secured to the free end of the hind part is a buckle to which a tail strap is anchored when such is required. Mounted on the fore part adjacent to its free end is a hook which is adapted to have an over-check rein or strap attached thereto.

Secured to the underface of the hind part of the top strap is a rear cross strap in the shape of an inverted U which presents a substantially flat back and two depending legs. Each of these legs has mounted thereon a buckle. These two buckles are used to secure a breeding strap in position which such is required. Suspended from the lower free end of each leg is a rear strap hanger in the form of a loop which is adjustable in its effective length.

Secured to the underface of the fore part of the top strap is a front cross strap also of inverted U shape presenting a flat back and two depending legs. Secured to and upstanding from the back of the front cross strap on opposite sides of the top strap are a pair of rings which are adapted to have reins passed therethrough. Suspended from the lower end of the legs of the front cross strap are a pair of front strap hangers each of which is in the form of an adjustable loop. A U shaped breast strap has its ends adjustably secured to the front strap hangers adjacent to the upper ends of the latter.

A body strap is supported by the strap hangers and comprises four elements: two side parts of an elastic material, a U shaped hindpart and a U shaped fore part. The free ends of the U shaped hind and fore parts are adjustably attached to the corresponding ends of the side parts. The center of the U shaped fore part is provided with a device for attaching a lead line thereto.

For a full and more complete understanding of the invention reference may be had to the following description and accompanying drawings wherein.

DESCRIPTION OF A PREFERRED EMBODIMENT

Figure 1:
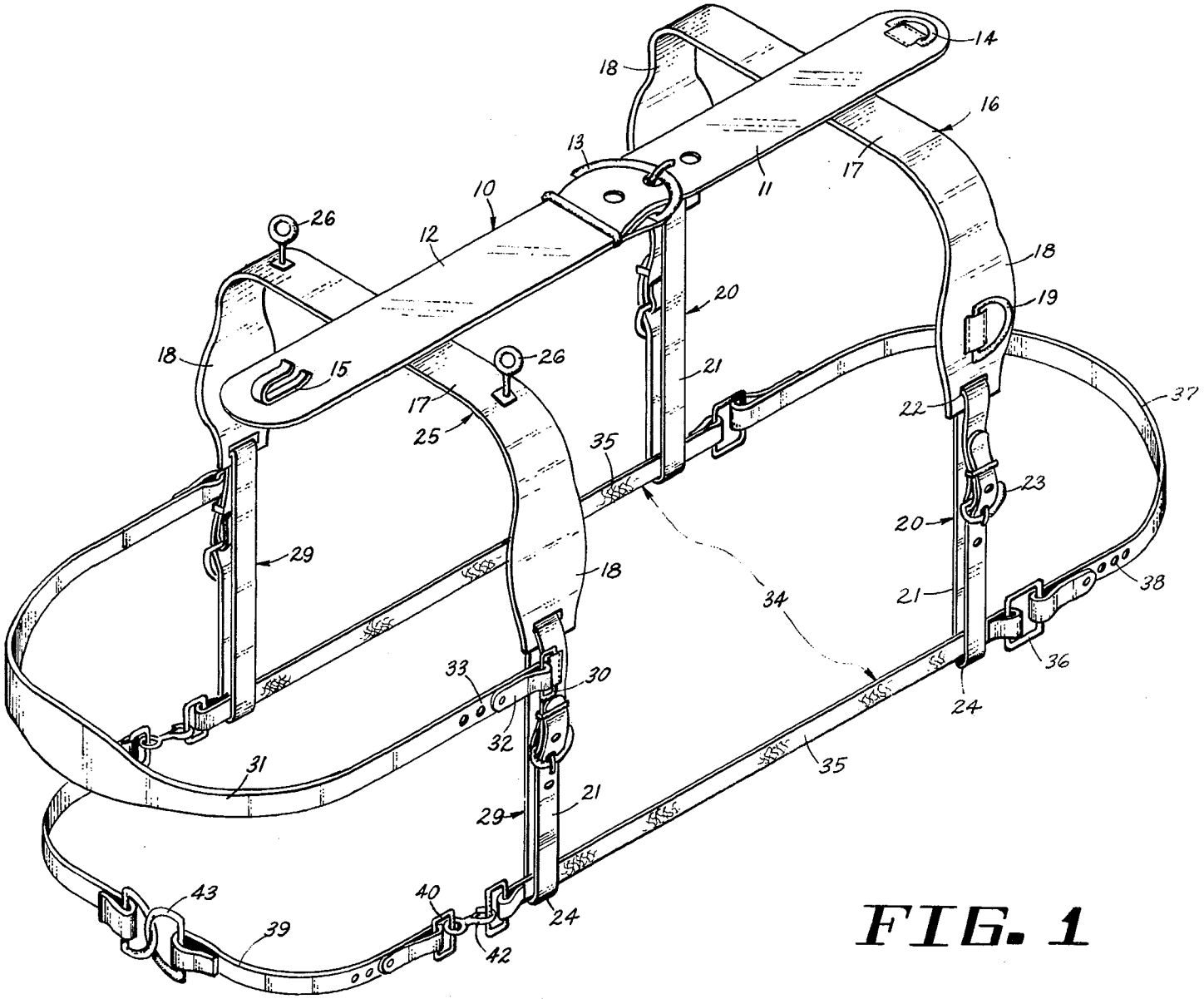
FIG. 1 is a perspective of an all purpose training harness embodying the precepts of this invention.
Figure 2:
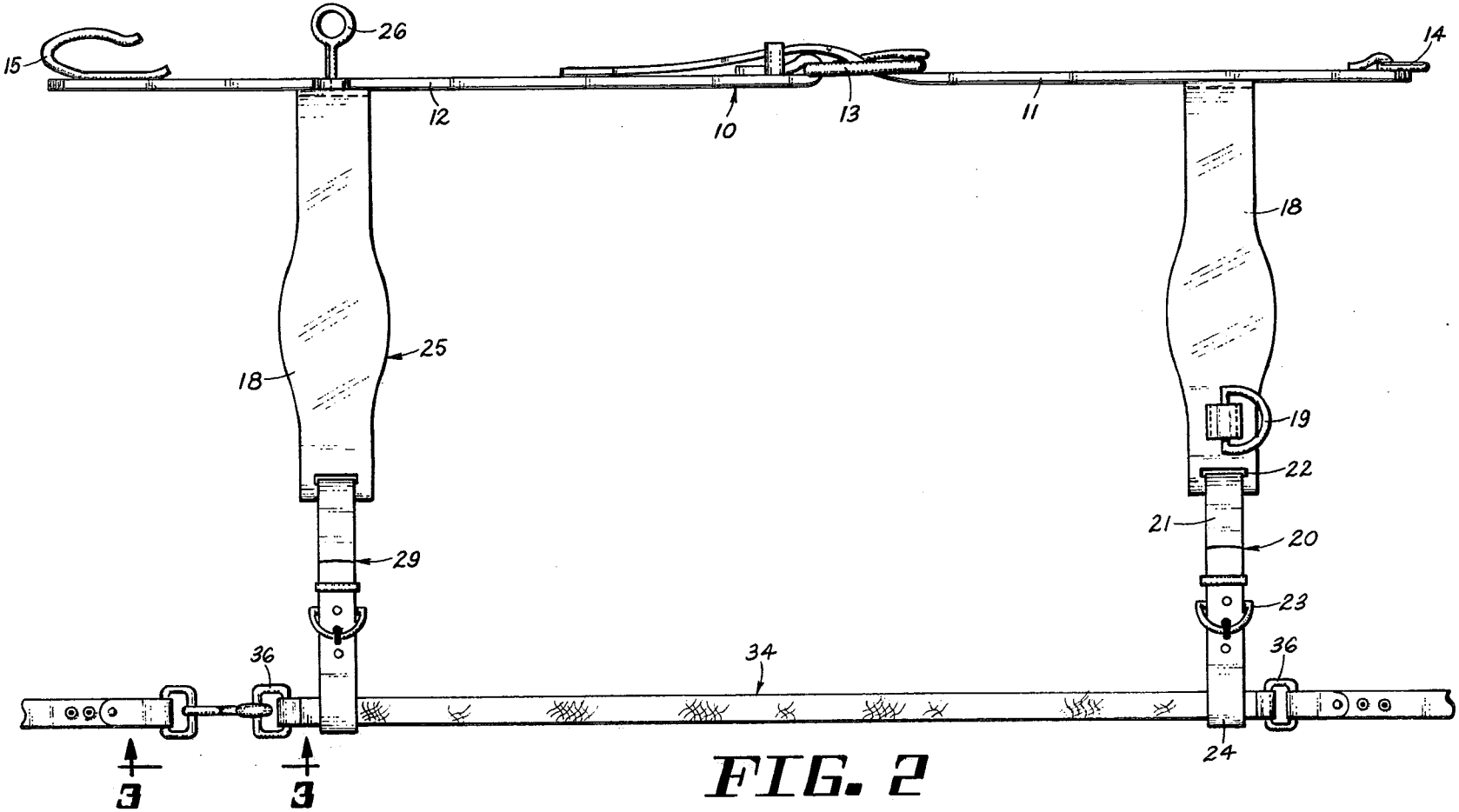
FIG. 2 is a side elevation of the central or main portion of the harness with the breast strap omitted and illustrating end portions only of the hind and fore parts of the body strap.

Referring now to the drawings wherein like reference characters denote corresponding elements throughout the several views, and first more particularly to FIG. 1, a top strap is identified in its entirety by the reference character 10. It comprises a leather hind part 11 and a fore part 12 also of leather. Parts 11 and 12 are secured to each other by a buckle 13 which provides for adjusting the effective or over all length of top strap 10. Buckles of this type are well known and it is therefore believed to be unnecessary to herein describe details of buckle 13.

Attached to the free end of hind part 11 is a buckle 14 which is used to secure a tail strap (not illustrated) in position when one is required. Mounted on the upper face of fore part 12 is a hook 15. Hook 15 constitutes an anchor for an over-check rein or strap (not illustrated) which is employed in some of the training procedures.

A rear cross strap is designated generally 16. It is of inverted U shape comprising a back 17 and depending legs 18. Back 17 is depicted as having its central portion secured to the underside of hind part 11. This particular relation is not a limitation on the invention as it could be attached to the upperside of hind part 11. Moreover this connection can be achieved in any well known manner as by stitching or riveting.

Each leg 18 has a buckle 19 mounted thereon adjacent to its lower free end. These buckles 19 are used to secure a breeding strap (not illustrated) in position when a horse is to be trained for breeding or for actual breeding.

Each of a pair of rear strap hangers is identified in its entirety at 20. Each hanger 20 comprises a strap 21 which is passed through a slot 22 in the lower end portion of a leg 18. The ends of strap 21 are adjustably connected by a buckle 23 to provide for variations in the effective length of hanger 20. It is evident that each hanger 20 presents a bend 24 at its lower end which is used to support a body strap to be later described.

Figure 4:
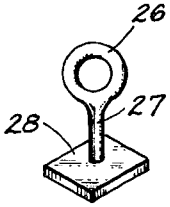
FIG. 4 is a perspective of one of the reining rings that is mounted on the front cross strap.

A front cross strap is indicated generally at 25. Like rear cross strap 16 it is of inverted U shape and presents a flat back and depending legs which are identified by the same reference characters used in designating these elements of rear cross strap 16. Mounting on and upstanding from back 17 of front cross strap 25 are a pair of rings 26 arranged on opposite sides of top strap 10. One of these rings 26 is shown in detail in FIG. 4 as being mounted on a stem 27 which upstands from a base plate 28 that is secured to the upper face of back 17 of cross strap 25 in any preferred manner.

Each of a pair of front strap hangers is identified generally at 29. Each of front hangers 29 is, with one exception, of the same construction as rear hangers 20. Hence a detailed description thereof is not herein repeated. The exception resides in the fact that the outer ply of strap 21 has mounted thereon a metallic loop 30. A breast strap 31 of U shape presents a pair of end portions 32 each of which is passed through a loop 31. It is then folded back on itself and secured to one of the snap fastener recesses 33 by forcing the male element of the fastener into the recess which will provide the required length of breast strap 31.

A body strap is indicated in its entirety at 34. It comprises two side parts 35 of an elastic material of which a rubberized fabric may be taken as exemplary. Each of these side parts 35 pass through and is supported by bends 24 of strap hangers 20 and 29 on one side and in sliding relation relative thereto. Secured to each end of each side part 35 is a metallic loop 36.

A hind strap 37 has end portions each of which is passed through a loop 36, folded back on itself and secured by urging the male element of a snap fastener into one of the female elements 38 to provide the desired length of hind strap 37.

Figure 3:
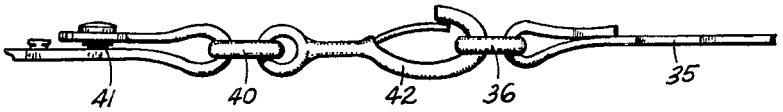
FIG. 3 is a detailed elevation taken in an enlarged scale of one of the adjustable connections between one end of a side part and one end of the fore part of the body strap.

A fore strap 39 of U shape has end portions each of which has secured thereto a metallic loop 30 (see FIG. 3). Each end portion of fore strap 39 is provided with a series of female elements of a snap fastener and mounted on each end is a male element 41 which is adapted to be received in any one of the female elements to provide a desired length in fore strap 39 as determined by the distance between loops 40. A spring locking hook clasp 42 is swiveled on each loop 40 and is hooked into a loop 36 at the front end of a side part 35.

Fore strap 39 is shown as consisting of two parts which are connected by metallic rings 43. These rings are located at the center of fore strap 39 and constitute means for anchoring a lead line (not illustrated) to the fore strap.

OPERATION OF A PREFERRED EMBODIMENT

While the manner in which the subject training harness is used is believed to be obvious from the illustrations of the drawings and description of the various elements set forth above, it is briefly outlined as follows:

Top strap 10, strap hangers 20 and 29, and body strap 34 are first adjusted so that the harness will fit a horse of a particular size with a required degree of snugness or slack as the case may be.

If a horse is to be trained for leading or loading into a trailer, a lead line is attached to the anchoring means represented by rings 43. As a pull is exerted on the lead line the elastic side parts 35 of body strap 34 will give to a degree which is important from the training aspect.

If the horse is to be trained for reining or driving, reins extending from the bit are passed through rings 26 and grasped by the trainer. When the horse is to be trained for breeding or during actual breeding, a breeding strap is anchored to buckles 19.

If the training for driving involves the use of an over-check rein, the latter is anchored to hook 15. If the horse is to be trained to become accustomed to a tail strap, the latter is secured to buckle 14.

While a preferred specific embodiment of the invention is herein disclosed it is to be clearly understood that the invention is not to be limited to the exact constructions, mechanisms and materials illustrated and described because various modifications may be provided in putting the invention into practice.

What is claimed is:

1. In an all purpose training harness for horses that is adjustable to fit horses of various sizes within a wide range, a. a top strap including two parts which are detachably connected by a buckle which provides for adjusting the length of said top strap, b. a rear cross strap of inverted U shape comprising a substantially flat back and a pair of legs depending from the ends of said back, said back having a central portion secured to said top strap, c. a rear strap hanger suspended from each leg and including means for adjusting its effective length, d. a front cross strap of inverted U-shape providing a substantially flat back and a pair of legs depending from the ends of said back, said front strap having a central portion secured to said to strap, e. a front strap hanger suspended from each of said legs and including means for adjusting the effective length thereof, f. a breast strap having ends attached to said front strap hangers; and g. a body strap supported by said strap hangers and comprising:

I. two elastic side parts each presenting rear and front ends,

II. a U-shaped hind strap having ends adjustably connected to the rear ends of said side parts, III. a U-shaped fore strap having ends adjustably connected to the front ends of said side parts; and IV. means on said fore strap for attaching a lead line thereto; and h. each leg of each cross strap being formed with a slot and each strap hanger comprising a strap loop that is passed through one of said slots with its end being adjustably connected by a buckle whereby each strap hanger includes a bend at its lower end with all of said bends receiving and supporting said body strap, and in which the elastic side parts of the body strap are slidably received in said bends and include front end portions projecting beyond the bends in which they are received.

2. The training harness of claim 1 in which each of the front strap hangers is provided with a loop adjacent to its upper end and the breast strap has end portions each of which is passed through one of said loops, is folded back on itself and secured by a detachable connection to provide for adjusting the effective length of said breast strap.

3. The training harness of claim 1 in which each end of each elastic side part of the body strap has a metallic loop secured thereto and each end of the hind strap has an end portion that is passed through one of said loops, folded back on itself, and secured by a detachable connection whereby the effective length of said hind strap is rendered adjustable.

4. The training harness of claim 3 in which a spring lock hook clasp is included in the end portions of the fore strap and is connected to the loops at the front ends of said side parts.

* * * * *